United States Patent [19]

Niimura et al.

[11] Patent Number: 4,943,214

[45] Date of Patent: Jul. 24, 1990

[54] TWO-SHAFT TYPE ROTARY MACHINE HAVING A TIP CIRCLE DIAMETER TO SHAFT DIAMETER WITHIN A CERTAIN RANGE

[75] Inventors: Yoshihiro Niimura; Ritsuo Kikuta; Katsuaki Usui, all of Tokyo, Japan

[73] Assignee: Ebara Corporation, Tokyo, Japan

[21] Appl. No.: 449,420

[22] Filed: Dec. 15, 1989

Related U.S. Application Data

[63] Continuation of Ser. No. 243,630, Sep. 13, 1988, abandoned.

[30] Foreign Application Priority Data

Sep. 19, 1987 [JP] Japan ..... 62-235274

[51] Int. Cl.[5] ..... F04C 18/18; F04C 25/02

[52] U.S. Cl. ..... 418/9; 418/150; 418/200

[58] Field of Search ..... 418/9, 150, 206, 200

[56] References Cited

U.S. PATENT DOCUMENTS

| | | | |
|---|---|---|---|
| 1,442,018 | 1/1923 | Wendell | 418/150 |
| 3,089,638 | 5/1963 | Rose | 418/150 |
| 4,210,410 | 7/1980 | Ohtani | 418/150 |

FOREIGN PATENT DOCUMENTS

| | | |
|---|---|---|
| 52-111007 | 9/1977 | Japan . |
| 54-130602 | 9/1979 | Japan . |
| 5591786 | 7/1980 | Japan . |
| 6014945 | 5/1985 | Japan . |
| 61-197793 | 9/1986 | Japan . |
| 62-189388 | 8/1987 | Japan . |
| 1148349 | 4/1969 | United Kingdom . |
| 2018897 | 10/1979 | United Kingdom . |
| 2088957 | 6/1982 | United Kingdom . |
| 2125485 | 3/1984 | United Kingdom . |

*Primary Examiner*—John J. Vrablik

*Attorney, Agent, or Firm*—Oblon, Spivak, McClelland, Maier, & Neustadt

[57] ABSTRACT

A two-shaft rotary machine for use in a vacuum pump system includes rotors having a specific profile whereby any vibration and noise generated by the machine is minimized and its efficiency is increased. The number of lobes of each rotor is three or more. The tip and root portions of each rotor are defined by circular arcs, respectively, which are made smoothly continuous with each other through an involute curve. The ratio of the diameter of the tip circle to the diameter of the root circle is selected to fall within a range which is given by a specific expression.

2 Claims, 4 Drawing Sheets

TWO-SHAFT TYPE ROTARY MACHINE HAVING A TIP CIRCLE DIAMETER TO SHAFT DIAMETER WITHIN A CERTAIN RANGE

This application is a continuation of application Ser. No. 243,630, filed on Sept. 13, 1988, now abandoned.

BACKGROUND OF THE INVENTION

The present invention relates to a two-shaft type rotary machine for use in a vacuum pump system, and more particularly to a machine called a "ROOTS" type machine which includes two rotors constituting in combination one stage and having respective shafts rotating in opposite directions to each other.

In order to allow a rotary machine to perform a stable operation, it is most important from the viewpoint of design to give sufficient rigidity to the rotating shaft. However, any excessive increase in the diameter d of the rotating shaft with respect to the outer diameter D of the rotor leads to a reduction in the theoretical displacement per revolution. It is, therefore, necessary to select an appropriate shaft diameter d with both the displacement and mechanical strength taken into consideration. Envelope, involute and cycloid profiles are generally known as rotor profiles of ROOTS type pumps. In the case of envelope and cycloid profiles, the ratio D/d of the rotor outer diameter D (the diameter of the tip circle) to the rotating shaft diameter d, that is, the shortest diameter (the diameter of the root circle), is primarily determined, whereas, in the case of an involute profile, the ratio D/d can be varied as desired by changing the pressure angle ($\alpha$) of the involute curve defined hereafter within a certain range.

Referring to FIG. 7, which shows a typical conventional involute type rotor, each of the tip portions 12*a* and 13*a* is defined by the circle of the rotor's outer diameter Do (the diameter of the tip circle) which intersects the involute curve portions 12*c* (13*c*), while each of the root portions 12*b* and 13*b* is defined by two circular arcs (radius $r_o$) which intersect the involute curve portions 12*c* (13*c*) and which also contact the circle of the diameter do. Pressure angle ($\alpha$) is defined as an angle formed between a line f tangential to base circles Rb of rotors 12 and 13 and a center line g perpendicular to a line h passing through both centers of the rotors 12 and 13. The base circle Rb is defined as a circle passing the meeting points of the involute curves 12*c* (13*c*) and circles 12*b* (13*b*) and concentric with the rotor 12 (13). The theoretical displacement volume per revolution is equivalent to 6 times (in the case of a three-lobe rotor) the trapping space 14 defined between the housing 11 and the rotor 12 and is generally expressed as follows:

$$V=KD^2L$$

V: theoretical displacement volume per revolution
D: outer diameter of rotor
L: rotor thickness (depth of the space occupied by the rotor)
K: coefficient of theoretical displacement.

The theoretical displacement coefficient K is determined by the rotor profile. Maximization of the theoretical displacement coefficient K enables an increase in the displacement of the pump.

In the case of the above-described involute type pump having the configuration exemplarily shown in FIG. 7, however, a sealed space 15 is defined at the area of meshing engagement between the rotors 12 and 13 and this space 15 is compressed by the meshing of the rotors 12 and 13 during the trapping process and then released toward the suction side. This phenomenon causes various drawbacks such as generation of vibration and noise, an increase in the power consumption and a reduction in the displacement and thus leads to losses in the pump operation. In particular, the prior art suffers from the problem that the sealed space 15 increases as the pressure angle ($\alpha$) becomes smaller.

SUMMARY OF THE INVENTION

In view of the above-described circumstances, it is a primary object of the present invention to provide an involute two-shaft type rotary machine which is so designed that it is possible to minimize the sealed space, which is one of the drawbacks of the above-described conventional involute type rotor, while ensuring the advantage of the involute type rotor whereby it is possible to select as desired the ratio D/d of the rotor's outer diameter D to the shaft diameter d by changing the pressure angle ($\alpha$) of the involute curve within a certain range.

To this end, the present invention provides a two-shaft type rotary machine including a housing having a suction port and a delivery port and at least two rotors constituting in combination one stage, the rotors being disposed within the housing and having respective shafts rotating in opposite directions to each other and serving to deliver a gas from the suction port toward a delivery port, wherein the improvement is characterized in that the tip portion of each of the rotors is defined by a circular arc (radius r) which has its center on the pitch circle (the circle of the diameter R shown in FIG. 1) of the rotor and which contacts an involute curve relatively smoothly, while the root portion of each of the rotors is defined by a circular arc of a radius r' (r+a clearance) which has its center on the pitch circle and which intersects the involute curve; the clearance between the rotors is maintained at a substantially constant level; and the ratio D/d of the diameter D (the diameter of the tip circle) of each rotor to the diameter d (the diameter of the root circle) is selected to fall within the range expressed as follows:

$$(n+1)/(n-1) \leqq D/d \leqq [1+\sin(180°/2n)]/[1-\sin(180°/2n)]$$

wherein n is the number of lobes of the rotor: $n \geqq 3$.

By virtue of the above-described arrangement, it is possible to select a shaft diameter d as desired within a certain range for a given rotor outer diameter D. With both the shaft rigidity and the coefficient of theoretical displacement per revolution (shown in FIG. 4) taken into consideration, an optimal shaft diameter d can be selected. Thus, it is possible to produce involute type rotors which are so designed that there is substantially no sealed spaced capable of causing generation of vibration and noise, increases in power consumption, reduction in the displacement, etc., and a substantially constant rotor clearance is ensured at all times.

DESCRIPTION OF THE PREFERRED EMBODIMENTS

One embodiment of the present invention will be described hereinunder with reference to the accompanying drawings.

Figure 1:
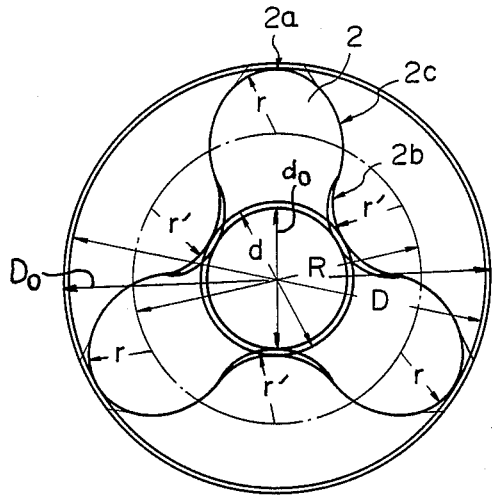
FIG. 1 shows the profile of one rotor of a two-shaft type pump according to the present invention.
Figure 2:
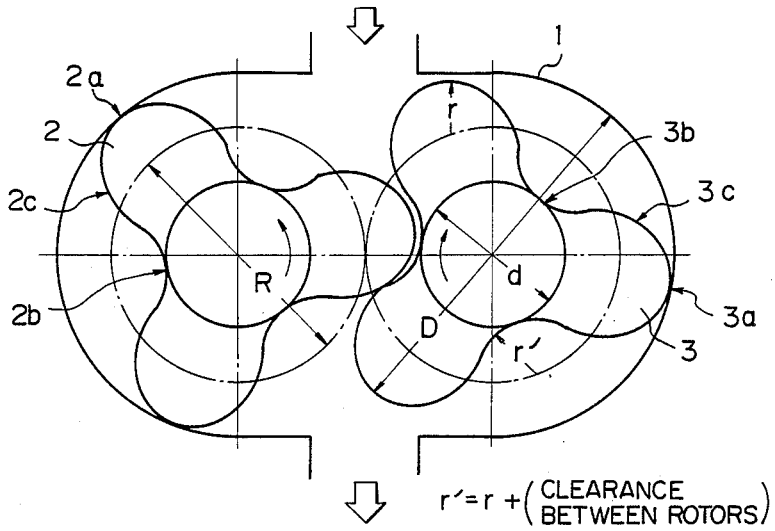
FIG. 2 schematically shows the cross-sectional structure of a pump employing the rotor shown in FIG. 1.

FIG. 1 shows the profile of one rotor of a two-shaft type pump according to the present invention, while FIG. 2 schematically shows the cross-sectional structure of a two-shaft type pump employing the rotor shown in FIG. 1. As will be clear from the figures, tip portions *2a* and *3a* of an outer diameter D are defined by respective circular arcs (radius r) each having its center on a pitch circle (diameter R) of a conventional involute type rotor and contacting the corresponding involute curve portions *2c* (or *3c*), and similarly root portions *2b* and *3b* are defined by respective circular arcs each having its center on the base circle and a radius r′ (r+a clearance) and each intersecting the corresponding involute curves, thus obtaining a new involute type rotor [outer diameter D(<Do), shortest diameter d(>do)] having a ratio D/d smaller than the ratio Do/do of the outer diameter Do to the shaft diameter do of the conventional involute type rotor.

Figure 3:
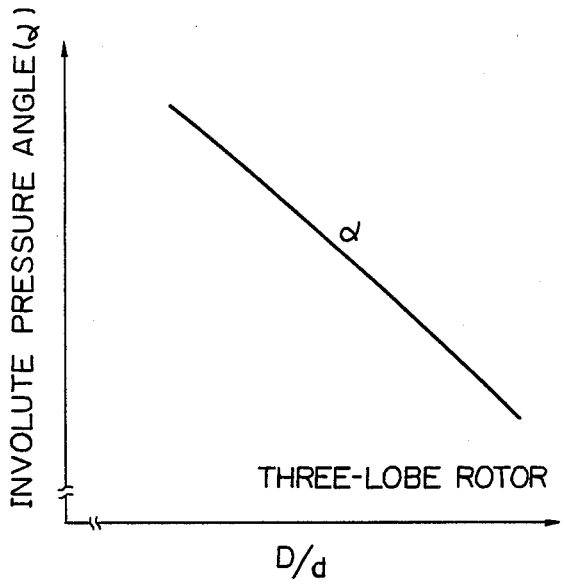
FIG. 3 shows the relationship between the ratio D/d of the outer diameter D of an involute type rotor to the shaft diameter d and the pressure angle ($\alpha$) of the involute curve.

FIG. 3 shows the relationship between the ratio D/d of the outer diameter to the shaft diameter of an involute type rotor and the pressure angle ($\alpha$) of the involute curve. It is possible from FIG. 3 to obtain the ratio D/d of the outer diameter D to the shaft diameter d with the pressure angle ($\alpha$) employed as a parameter. Since the pressure angle ($\alpha$) represents the profile of an involute curve, the ratio D/d of the outer diameter D to the shaft diameter d is constant for a given pressure angle ($\alpha$). Therefore, if the pressure angle is constant, the profiles of two rotors respectively having an outer diameter D and another outer diameter D′ which is different therefrom are similar to each other. This means that, when a given rotor outer diameter D is given, if a pressure angle ($\alpha$) is obtained from the diameter D and a shaft diameter d required for the rotating shaft of the rotor, the rotor profile is determined.

In the case where the rotors 2 and 3 are sealed by engagement with each other at the involute curve portions *2c* and *3c*, a substantially constant clearance is maintained by virtue of the characteristics of the involute curves, and a substantially constant clearance is maintained at all times at the area between a tip portion *2a* (*3a*) and a root portion *3b* (*2b*) by setting the radius of the circular arcs defining the root portions *2b* and *3b* so as to be r′ which is determined by adding the clearance to the radius r of the circular arcs defining the tip portions *2a* and *3a*.

Figure 7:
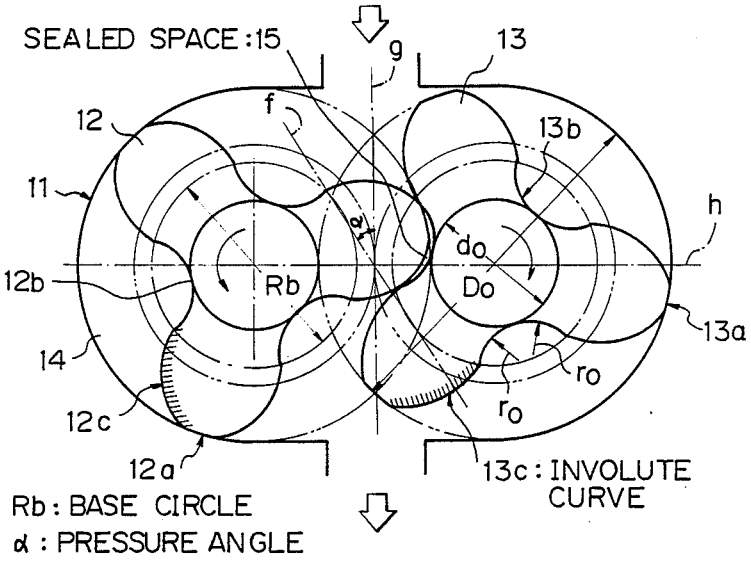
Fig. 7 PRIOR ART
FIG. 7 schematically shows the cross-sectional structure of the rotors of a conventional two-shaft type pump.

The above-described arrangement enables minimization of the sealed space 15, which is one of the drawbacks of the prior art, as shown in FIG. 7.

Figure 4:
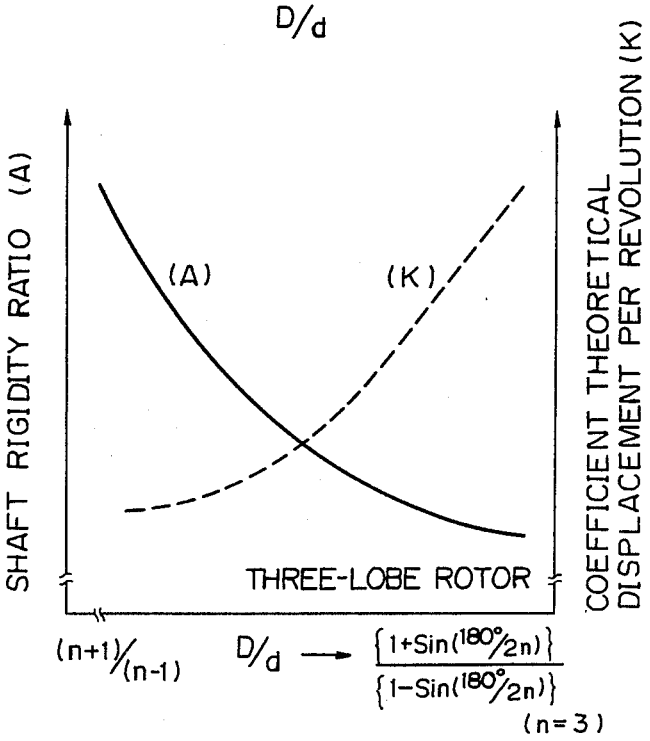
FIG. 4 shows the relationship between the ratio D/d of the outer diameter D to the shaft diameter d, the shaft rigidity ratio (A) and the theoretical displacement coefficient (K) per revolution.

As has been described above, since a shaft diameter d can be selected as desired within a certain range for a given rotor outer diameter D by employing the pressure angle ($\alpha$) of the involute curve as a parameter, it is possible to select an optimal shaft diameter d with both the shaft rigidity and the coefficient of theoretical displacement per revolution being taken into consideration, as shown in FIG. 4. More specifically, an optimal shaft diameter d can be selected within the following range between the ratio D/d of the outer diameter D to the shaft diameter d in the case of cycloid type rotors and that in the case of envelope type rotors in which two types of rotor having the ratio D/d is primarily determined by:

$$(n+1)/(n-1) \leqq D/d \leqq [1+\sin(180°/2n)]/[1-\sin(180°/2n)]$$

wherein n is the number of lobes of the rotor: $n \geqq 3$. In addition, there is substantially no sealed space between the rotors 2 and 3 and a substantially constant rotor clearance is maintained therebetween at all times.

Figure 5:
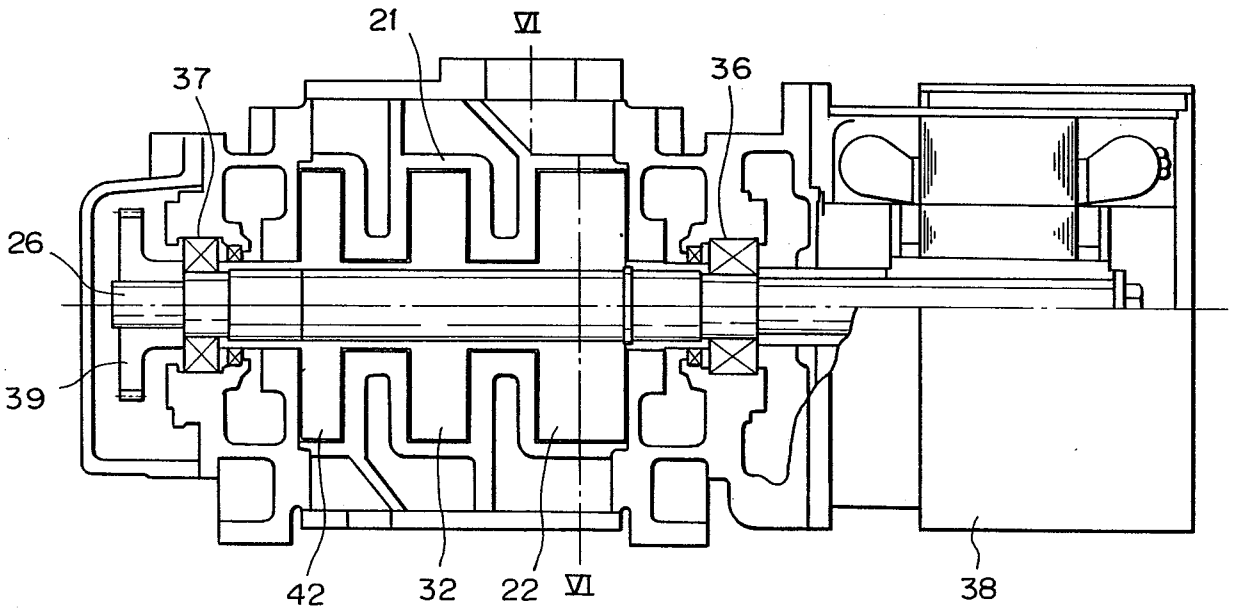
FIG. 5 is a sectional view taken along the axis of a rotating shaft carrying first rotors of a two-shaft type pump having rotors according to the present invention provided in a multistage structure.
Figure 6:
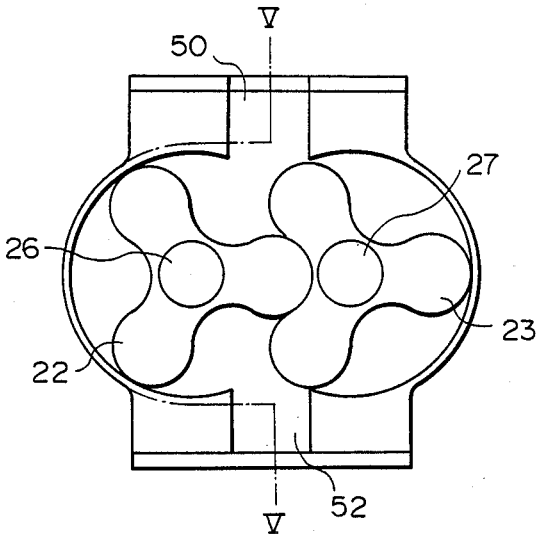
FIG. 6 is a sectional view taken along the line VI—VI of FIG. 5.

FIGS. 5 and 6 show in combination another embodiment in which the present invention is applied to a multistage vacuum pump. In this multistage vacuum pump, air is sucked into a first-stage pump comprising two three-lobe rotors 22 and 23 through a suction port 50 which is communicated with, for example, a vacuum chamber and the air is then discharged to a delivery port 52 where the pressure is somewhat higher than that at the suction port side. Subsequently, the air is introduced into a suction port (not shown) of a second-stage pump including a rotor 32 and is then discharged to a delivery port where the pressure is kept even higher by the operation of the second-stage pump. In this way, the air sucked in from the suction port 50 is passed through a plurality of pumps disposed in series, so that the pressure of the air is gradually raised and the air is discharged from the delivery port of the final stage pump. In the embodiment shown in FIG. 5, the air is discharged into the atmosphere from the delivery port of the third-stage pump including the rotor 42.

In the embodiment shown in FIG. 5, one rotating shaft 26 which is supported by bearings 36 and 37 rigidly secured to a housing 21 carry the first rotors 22, 32 and 42 in the first to third stages. The rotating shaft 26 is driven by the operation of a motor 38 which is operatively connected to one end of the shaft 26. The rotating shaft 26 is arranged to rotate synchronously with the other rotating shaft 27 which carries the other, or second, rotors (only the first-stage rotor 23 is shown in FIG. 6) in the first to third stages by the operation of a timing gear 39 which is provided at the other end of the rotating shaft 26.

In the multistage pump shown in FIG. 5, the load on each of the rotating shafts 26 and 27 is likely to increase because each shaft carries a plurality of rotors. However, it is possible in the present invention to select the shaft diameter d so that the maximum stress of each rotating shaft is less than a predetermined value by employing involute type rotors and selecting an appropriate value for the pressure angle of the involute curves, and it is hence possible to give an appropriate mechanical strength to the rotating shafts. In addition, it is possible to eliminate substantially the sealed space by defining the tip and root portions of the rotors by circular arcs and therefore to minimize the generation of vibration and noise.

Although in the above-described embodiments three-lobe rotors are employed, it is a matter of course that the present invention may be applied to any rotor which has three or more lobes. It should be noted that a groove or other local area which is outside of a circular arc may be formed at the tip portion of each rotor.

As has been described above, the present invention provides the following advantages.

For a given rotor outer diameter D, it is possible to select an optimal shaft diameter d within a certain range while taking into consideration both the shaft rigidity and the coefficient of theoretical displacement per revolution as exemplarily shown in FIG. 4. Thus, it is possible to provide a two-shaft type pump employing involute type rotors which are so designed that there is substantially no sealed space capable of causing generation of vibration and noise, increases in power consumption, reduction in the displacement, etc., and a substantially constant rotor clearance is ensured at all times.

What is claimed is:

1. A two-shaft type rotary machine for use in producing vacuum comprises, a housing having a suction port, a delivery port, and a plurality of stages, each stage having two rotors in combination, said rotors being disposed within said housing and having respective shafts rotating in opposite directions to each other to deliver a gas from said suction port toward said delivery port:

wherein each of said rotors has tip and root portions defined by circular arcs, respectively, said tip and root portions being made smoothly continuous with each other through an involute curve, a clearance between said rotors being maintained at a substantially constant level, with the ratio D/d of the outer diameter D of the tip circle of each rotor to the shaft diameter d of the root circle being selected to fall within the range expressed as follows:

$$(n+1)/(n-1) \leqq D/d \leqq [1+\sin(180°/2n)]/[1-\sin(180°/2n)],$$

wherein n is the number of lobes of the rotor and $n \geqq 3$, said two shafts being elongated, and a plurality of rotors being provided on each of said shafts to constitute a plurality of stages.

2. A two-shaft type rotary machine according to claim 1, wherein each of said rotors has tip and root portions defined by respective circular arcs each having its center on a pitch circle of one of the rotors.

* * * * *